United States Patent [19]

Wright

[11] 4,347,982

[45] Sep. 7, 1982

[54] OIL BURNER NOZZLE

[75] Inventor: Donald G. Wright, Rockville Center, N.Y.

[73] Assignee: Adelphi Research Center, Inc., Garden City, N.Y.

[21] Appl. No.: 54,244

[22] Filed: Jul. 2, 1979

[51] Int. Cl.[3] ..... B05B 7/10

[52] U.S. Cl. ..... 239/405; 239/423; 239/424.5

[58] Field of Search ..... 239/399, 405, 433, 434.5, 239/424, 424.5

[56] References Cited

U.S. PATENT DOCUMENTS 2,254,123 8/1941 Soaper ..... 239/405
3,163,362 12/1964 McFee ..... 239/405 X
3,346,196 10/1967 Biber ..... 239/424 X
3,790,086 2/1974 Masai ..... 239/434.5 X

*Primary Examiner*—Richard A. Schacher
*Attorney, Agent, or Firm*—Wyatt, Gerber, Shoup, Scobey & Badie

[57] ABSTRACT

An oil burner nozzle for use with liquid fuels and solid-containing liquid fuels. The nozzle comprises a fuel-carrying pipe, a barrel concentrically disposed about the pipe, and an outer sleeve retaining member for the barrel. An atomizing vapor passes along an axial passageway in the barrel, through a bore in the barrel and then along the outer surface of the front portion of the barrel. The atomizing vapor is directed by the outer sleeve across the path of the fuel as it emerges from the barrel. The fuel is atomized and may then be ignited.

5 Claims, 3 Drawing Figures

OIL BURNER NOZZLE

The United States Government has rights in this invention pursuant to Contract Number Ex-76-S-01-2437 awarded by the U.S. Department of Energy.

BACKGROUND OF THE INVENTION

This invention relates to an oil burner nozzle. More particularly, this invention relates to an oil burner nozzle which increases the efficiency of combustion of liquid and solid-containing liquid fuels by atomizing such fuels.

With the increased public concern about the cost and the availability of oil, it has become desirable to design oil burners and, more particularly, oil burner nozzles, that are more efficient than the ones currently in use. Atomization is a well-known process for increasing the efficiency of combustion. However, conventional oil burner nozzles which atomize these fuels are not designed to operate at low rates of fuel flow.

Because solid combustibles, such as coal, are more abundant than oil, another desirable goal is to design an oil burner nozzle which can utilize solid-containing liquid fuels as well as purely liquid fuels. In prior art devices, such as that described in U.S. Pat. No. 733,579, the fuel must pass through constricted passageways. These passageways would tend to clog in the presence of solids. While some devices, such as those described in U.S. Pat. Nos. 2,933,259 and 2,929,290, are described as capable of atomizing solid-containing liquid fuels, it is obvious that the solid matter would have to be highly pulverized in order to prevent clogging. Moreover, these latter two devices are complicated and require careful machining.

Thus, there is a need for a simple and inexpensive oil burner nozzle, capable of operating at low rates of fuel flow, and capable of atomizing solid-containing liquid fuels as well as liquid fuels. This invention is directed to providing a device meeting such needs.

SUMMARY OF THE INVENTION

The present invention provides an oil burner nozzle comprising a pipe for carrying fuel, a barrel disposed about the pipe, and an outer sleeve disposed about the barrel. The pipe transports the fuel through the barrel to an outlet. The barrel has a main body and a smaller front portion, an axial passageway which carries an atomizing vapor from the main body to the front portion of the barrel, and a lateral bore which conducts the atomizing vapor from the axial passageway to the outer surface of the front portion of the barrel. The outer sleeve forms a converging chamber about the front portion of the barrel and directs the atomizing vapor across the path of the fuel emerging from the barrel.

In a preferred embodiment, the barrel and outer sleeve are cylindrical and are concentrically disposed about the fuel pipe which passes through the axial passageway. The exit orifice of the outer sleeve abuts against the front portion of the barrel and the front portion has grooves scored into its outer surface at an angle oblique to the axis of the barrel.

BRIEF DESCRIPTION OF THE DRAWINGS

The accompanying drawings show a preferred embodiment of the present invention.

DETAILED DESCRIPTION

Figure 1:
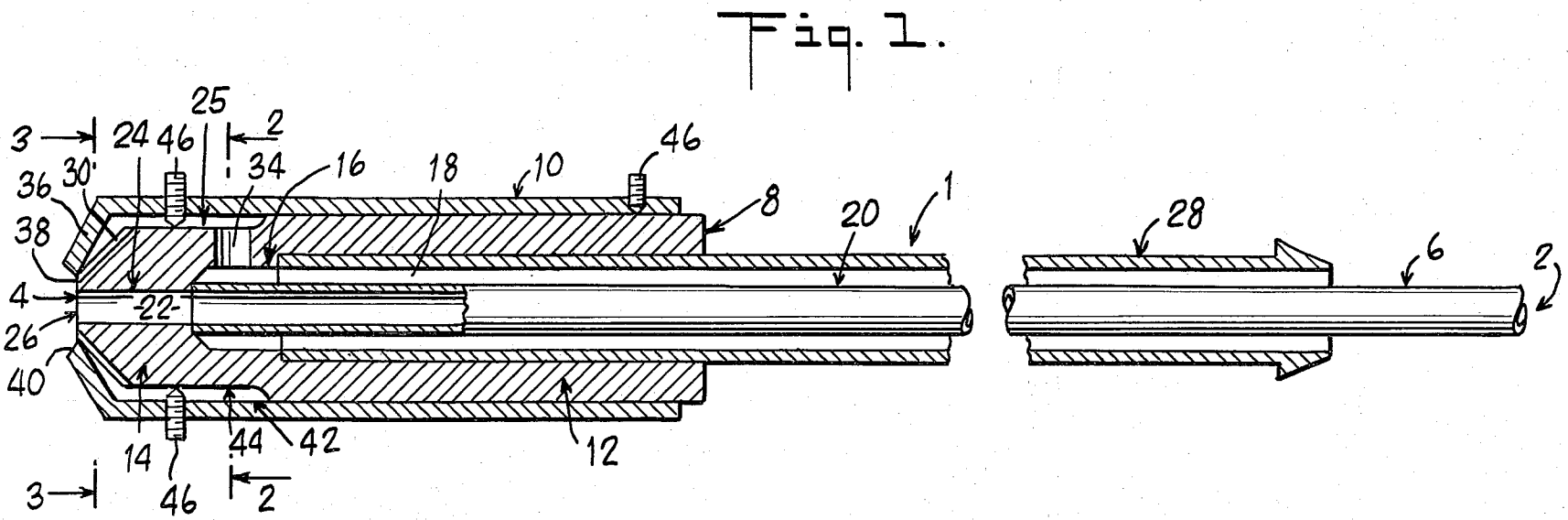
FIG. 1 is a longitudinal sectional view of the device.
Figure 2:
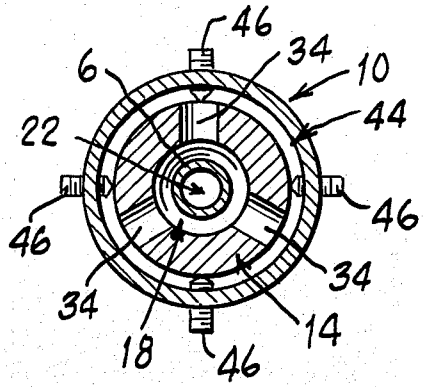
FIG. 2 is a cross-sectional view of the device taken along line 2—2 of FIG. 1.
Figure 3:
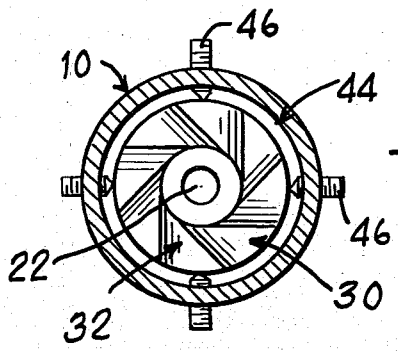
FIG. 3 is a cross-sectional view of the device taken along line 3—3 of FIG. 1.

Referring to the specific embodiment illustrated in the accompanying drawings, the oil burner nozzle of the present invention, generally indicated as 1, has a fuel entry end 2 and a fuel exit end 4. The nozzle shown comprises fuel carrying pipe 6, barrel 8 concentrically disposed about pipe 6, and outer sleeve 10 concentrically disposed about barrel 8. As shown, both barrel 8 and outer sleeve 10 are cylindrical in shape. Barrel 8 is a substantially solid member having a main body portion 12 and a smaller front portion 14 of frusto-conical shape. Barrel 8 has a central borehole 18 formed with an inner surface 16 in the main body 12. The diameter of central borehole 18 is sufficiently larger than the outer diameter of fuel carrying pipe 6 so that an axial passageway to admit atomizing vapor is formed between the outer surface of pipe 6 and the inner surface 16 of barrel 8. Borehole 18 has a narrow segment 22 formed by inner surface 24 which closely receives fuel pipe 6 within front portion 14. Borehole 18 terminates as outlet 26 which functions as exit end 4 of the nozzle. A second pipe 28 concentrically disposed about fuel pipe 6 and dimensioned to be received within the wide segment of borehole 18 may be used to introduce the atomizing vapor within the borehole 18.

Front portion 14 of barrel 8 is formed with a face 30 beveled in the direction of the fuel exit end 4 of the burner nozzle 1. At least one and preferably a plurality of grooves 32 are scored preferably symmetrically into face 30 at an angle oblique to the axis of the barrel 8. Lateral bores 34 communicate the atomizing vapor from the wide segment of borehole 18 to the outside surface 25 of the front portion 14.

Outer sleeve 10 is a hollow member having a sloped front end 36 and a central exit orifice 38. The inner edge 40 of exit orifice 38 abuts beveled face 30 of the barrel near outlet 26. As shown, outer sleeve 10 is dimensioned to engage slidably the main body 12 of barrel 8 but to leave a gap between the inner surface 42 of the outer sleeve and the outer surface 25 of front portion 14. As both barrel 8 and outer sleeve are cylindrical and as their front faces intersect each other, the gap forms an annular chamber 44 converging upon exit orifice 38. When atomizing vapor under pressure enters annular chamber 44, inner surface 42 acts as a deflecting plate, directing the atomizing towards exit orifice 38. Set screws 46 are placed in outer sleeve 10 in order to keep outer sleeve 10 in spatial alignment with barrel 8.

In operation, fuel passes through barrel 8 via fuel pipe 6 and borehole 18, emerging at outlet 26. The atomizing vapor is introduced under slight pressure, for example, at 7 to 12 p.s.i.g., into the wide segment of borehole 18 by pipe 28. The narrowness of segment 22 of the borehole prevents the atomizing vapor from traveling the length of barrel 8. From borehole 18 the atomizing vapor is forced through lateral bores 34 into annular chamber 44. Inner surface 42 deflects the path of the atomizing vapor along outer surface 25 and beveled face 30 of the front portion 14. As edge 40 of orifice 38 abuts against beveled face 30, the only avenues of escape for the atomizing are through grooves 32. The vapor issues from annular chamber 44 through grooves 32 in a swirling motion, shearing across the path of the fuel emerging from outlet 26. The fuel is thereby atomized and may be ignited for efficient combustion.

The angle of inclination of beveled face 30 can be varied to control the size of the flame. Preferably, the angle should be from 20° to 45° from horizontal.

The atomizing vapor may be air, steam or any other conventional gas used for such purposes. The nozzle is suitable for use with purely liquid fuels and with liquid fuels containing up to 50% or more solid particles. These particles may range from 1 to 100 microns or more in diameter. In actual operation, the following fuels have been used successfully: Nos. 2, 4, 5 and 6 heating oils; coal and oil mixtures with concentrations up to 50% coal; wood oil; mixtures of coal/water/oil, coal/wood oil, wood oil/oil, wood oil/water/oil, wood particles/wood oil, wood particles/oil, wood particles/coal/oil, and other combinations thereof.

The nozzle of the present invention is highly efficient at both low and high fuel flow rates. For example, the nozzle has been successfully used at flow rates as low as one-half gallon per hour, a flow rate suitable for small-scale, residential oil burners. Alternatively, larger nozzles capable of handling as much as two thousand gallons of fuel per hour may be constructed. A battery of such nozzles may be used to burn the ten to twenty-five thousand gallons of fuel per hour needed to heat large-scale apartment houses.

While the present invention has been described with reference to a specific embodiment, it should be understood that numerous changes in the details of construction may be made without departing from the spirit and scope of the invention.

What is claimed is:

1. A burner nozzle capable of atomizing a liquid fuel containing combustible particulates, comprising a barrel member having an unrestricted inner passage extending to the exterior of said nozzle for conveying said fuel to an outlet located exteriorly of said nozzle, said barrel member having an outer passageway disposed around said inner passage for conveying atomizing vapor towards the forward end portion of said barrel member and outward laterally therefrom, and means including a sleeve member held over said barrel member and forming with said forward portion a converging chamber extending to said outlet to direct said vapor across said outlet for atomizing said fuel exteriorly of said nozzle.

2. A burner nozzle according to claim 1, said barrel member having a borehole formed centrally therein, said borehole having a first diameter in the rearward portion of said barrel member and narrowing to a reduced diameter portion in said forward portion, and a pipe member fitted to said reduced diameter portion of said borehole to form said inner passageway therethrough and said outer passage therearound.

3. A burner nozzle according to claim 2, the outer surface of the forward portion of said barrel member being recessed to form said converging chamber.

4. A burner nozzle according to claim 1, 2 or 3, the front portion of said barrel member being beveled with at least one groove formed therein, said sleeve member extending over said beveled front portion and abutting thereon.

5. A burner nozzled according to claim 4, including a plurality of said grooves each extending obliquely toward said outlet.

* * * * *